United States Patent [19]

DeVries, Jr. et al.

[11] 4,089,145

[45] May 16, 1978

[54] METAL ROOF CONSTRUCTION

[75] Inventors: William S. DeVries, Jr., Ada; Elmer M. Malek, Grand Rapids, both of Mich.

[73] Assignee: Wm. DeVries & Sons, Inc., Grand Rapids, Mich.

[21] Appl. No.: 719,351

[22] Filed: Sep. 1, 1976

[51] Int. Cl.[2] ..... E04C 1/38

[52] U.S. Cl. ..... 52/461; 52/469; 52/630

[58] Field of Search ..... 52/630, 465, 528, 335, 52/336, 588, 460, 395, 467–472

[56] References Cited

U.S. PATENT DOCUMENTS

| | | | |
|---|---|---|---|
| 1,307,187 | 6/1919 | Disbro | 52/588 |
| 1,868,159 | 7/1932 | Bonsall | 52/467 |
| 2,093,756 | 9/1937 | Gilpin | 52/467 |
| 2,095,434 | 10/1937 | Calkins | 52/469 |
| 3,213,583 | 10/1965 | Winski | 52/395 |
| 3,603,056 | 9/1971 | Roth | 52/460 |
| 3,708,943 | 1/1973 | Thomas | 52/588 |
| 3,849,956 | 11/1974 | Collins | 52/469 |

FOREIGN PATENT DOCUMENTS

| | | | |
|---|---|---|---|
| 174,295 | 1/1935 | Switzerland | 52/528 |
| 663,390 | 1/1951 | United Kingdom | 52/469 |

OTHER PUBLICATIONS

R-S 18 Roofing Systems by Wm. DeVries & Sons, Inc.

*Primary Examiner*—Ernest R. Purser
*Assistant Examiner*—Henry Raduazo
*Attorney, Agent, or Firm*—McGarry & Waters

[57] ABSTRACT

A metal roof construction of the type wherein elongated metal panels are joined together at upstanding vertical side walls by a crimped batten strip. Shallow step strengthening ribs are positioned closely adjacent to the side walls to strengthen the side walls and prevent buckling and to promote flexure of the panel central portions at the step strengthening ribs under high upward stresses on the panels. The panels are secured to underlying roof support means through a special clip having a radius of curvature between an upstanding body portion, positioned between side walls of adjacent panels, and a lower flange portion, positioned beneath a panel. The radius of curvature is sufficient to accommodate the head of a threaded fastener between the clipped lower flange and an overlying panel. Radius bends are also provided between the clipped body portion and top flanges which overlie inwardly directed flanges on the panel side walls. Because of the flatness of the panels, conventional caulking can be used between overlying panels and between the panels and the supporting purlins at the eaves and ridges of the roof.

20 Claims, 3 Drawing Figures

METAL ROOF CONSTRUCTION

BACKGROUND OF THE INVENTION

1. Field of the Invention This invention relates to a metal roof construction. In one of its aspects, the invention relates to a relatively strong metal roof construction of relatively flat panels with substantially vertical upstanding side walls wherein conventional caulking is used at the ends of the roof and between overlapping panels.

2. Description of the Prior Art

Metal roof constructions have been used for many years on buildings of various sizes and shapes. Most recently, metal roofs have been used on commercial buildings having slightly sloped roofs because of the durability, strength and ease of assembly of these constructions.

Typically a metal roof construction will be formed from a plurality of metal panels joined together at the edges through a batten strip of other means at the side walls. Clips positioned between adjacent panels are secured to supporting purlins and retain portions of the side walls to secure the panels to the purlins. Examples of basic metal roof constructions are disclosed in the U.S. patents to Herberling, U.S. Pat. No. 364,251, issued June 7, 1887, Perry, U.S. Pat. No. 1,240,773, issued Sept. 18, 1917, and Hayman, U.S. Pat. No. 1,693,274, issued Nov. 27, 1928.

Metal roof panels are fairly strong but are subject to buckling under high winds as, for example, hurricane or gale force winds. These winds tend to produce an upward force or lift on the roof structure. When the metal fasteners are strong enough to hold the panels at the edges thereof, the central portions of the panels are forced upwardly and the sides of the panels are thereby drawn inwardly at the base of the upstanding side walls. When the elastic limit of the metal is exceeded, the panels will deform at the upstanding side walls to permit the sides of the panels to move inwardly to accommodate the upward force at the panel centers. Certain standard strength tests have actually been developed by Underwriters Laboratories, Inc. to rate the strength of various roof systems. Insurance rates for building are set in part by the Underwriters Laboratory rating for the roofs.

Various techniques have been employed to strengthen the roof panels to avoid failure from high winds and the like. Obviously, the gauge of metal used can be increased. However, thicker gauge metal will increase the cost as well as the weight of the roof. Strengthening the panels while maintaining a relatively light gauge of metal has included modifying the side walls of the panels so that the panels are spaced apart at the bottom portions thereof. Secondly, corrugations of various sizes and shapes have been provided in the central portions of the panels. Examples of such roof constructions are illustrated in the U.S. patent to Eason, U.S. Pat. No. 2,234,799, issued Mar. 11, 1941, Webb, U.S. Pat. No. 3,520,100, issed July 14, 1970, Day et al, U.S. Pat. No. 3,858,373, issued Jan. 7, 1975. Other examples of roof constructions currently in existence are disclosed in a Butler Manufacturing Company publication entitled "Standing Seam Roof Comparison Chart."

These techniques tend to strengthen the roofs but create other problems. The corrugations create gaps between the panels and supports at the eaves and at the ridges. Special insulation must be provided at such places to seal the roofs. This special insulation increases the cost and decreases the ability to tightly seal the roofs and panels at the edges. Further, corrugations tend to reduce the aesthetic appeal of the roof and make it harder to walk on for repair and installation.

SUMMARY OF THE INVENTION

According to the invention, an improved, strengthened metal roof construction has been provided wherein the panels of the roof have a relatively flat central portion and have substantially vertically upstanding side walls. The roof construction is secured to a plurality of roof support means, such as conventional purlins, and comprises a plurality of elongated panels joined together at the edges thereof, each panel having a relatively flat central portion flanked by a pair of upstanding substantially vertical side walls with inwardly directed flanges at the top portions thereof. Means extend between adjacent panels and over the top of the inwardly directed flanges of the panel side walls for securing the panels to the roof support means. An elongated batten strip is crimped around the joint between adjacent panels at the side wall flanges so that the side walls of the panels are in abutting relationship substantially along the entire height thereof.

According to the invention, an elongated, shallow step strengthening rib is formed in the panel central portion and extends the length of each panel in closely adjacent relationship to each side wall thereof. The step rib is shallow enough so as to maintain the relatively flat nature of the panel central area and is positioned with respect to the side walls so that flexure of the panel central portion under high upward stress takes place at the strengthening rib. Further, the step rib is so shaped and positioned that it strengthens the base of the side wall against buckling, thereby significantly decreasing the buckling of the panels at the bottom portion of the side walls under high upward stresses.

The size, shape and position of the step strengthening ribs are quite important in providing the needed strength to achieve high wind ratings. The perameters will vary depending on the relative sizes of the central and side wall portions of the panels. Each of the ribs is in the nature of a small step which can extend above or below the plane of the panels at the edges of the side walls. Typically, the height of the strengthening rib is such that the ratio of the side walls height to the strengthening rib height is greater than 100 to 1 and preferably about 300 to 1. The spacing of the strengthening rib from the side wall can also vary. Typically, the ratio of the width of the panel to the distance from the side wall to the strengthening step rib will be in the range of about 18 to 1 to 23 to 1, preferably about 20.5 to 1. For example, in a panel 18 inches wide having a side wall height of 2 and $\frac{3}{4}$ inches, the step rib will be about 3/32 of an inch high and will be spaced about $\frac{7}{8}$ of an inch from the adjacent side wall. The width of the step rib is generally greater than the height but can be approximately the same. The width of the step rib in a typical example will be about 3/32 of an inch to about $\frac{1}{4}$ of an inch, preferably about 3/16 of an inch in the example given above.

In a typical panel, other step ridges can also be formed in the central portion of the panel. Typically, the ribs are so shallow that the central portions of the panel actually rest on the underyling support means.

Also according to the invention, the panel securing means comprises a clip of sheet metal having an upstanding body portion which is positioned between the side walls of adjoining panels, a bottom flange which is bent laterally of the body portion at a bottom portion thereof beneath an overlying panel, and top flanges which are bent laterally of the body portion at a top portion thereof and in overlying relationship with the inwardly directed flanges of the panel side walls. A threaded fastener having a head passes through the clip bottom flange and secures the clip to the roof support means. The bend between the clip body and the lower flange has a radius sufficient to accommodate the head of the threaded fastener between the top surface of the clip bottom flange and the undersurface of the panel lying above the fastener. Desirably, the bends between the top flanges and the body portion have a smooth radius of curvature to maximize the strength of the clips.

The invention permits the use of solid, flat and relatively compressible caulking material between the ends of the panels and the support means so that the roof panels can be sealed from moisture.

Thus, the invention provides an attractive and strong roof system which is moisture tight and uses conventional caulking materials. Further, the roof system is simple in construction and easy to assemble at the job site. Further, the panels are easy to manufacture, thus minimizing the manufacturing costs.

BRIEF DESCRIPTION OF THE DRAWINGS

The invention will now be described with reference to the accompanying drawings in which.

DESCRIPTION OF THE PREFERRED EMBODIMENT

Figure 1:
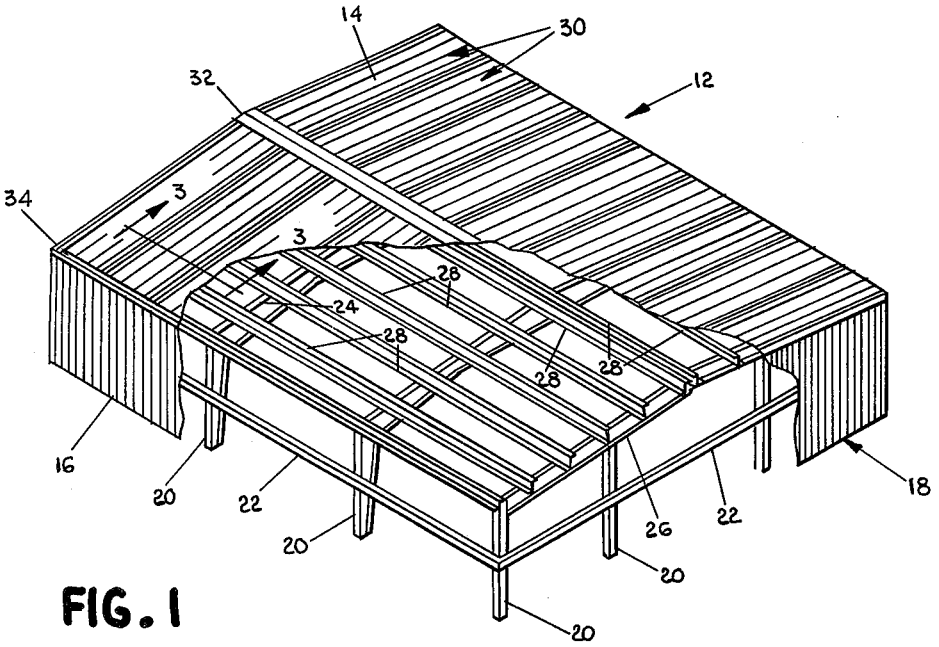
FIG. 1 is a perspective view, partially broken away, of a building incorporating a roof structure in accordance with the invention.

Referring now to the drawings, and to FIG. 1 in particular, there is shown a building 12 having a roof 14, side walls 16 and end walls 18. The side walls 16 and the end walls 18 are of the metal panel type and the internal framing is conventional. The framing may include columns 20, girts 22, girders 24, end wall rafters 26 and purlins 28. Roof panels 30 are interlocked together and form the roof. The roof panels 30 extend from a top ridge 32 to the eaves 34. Certain other parts of the internal framing have been omitted for the sake of clarity.

Figure 2:
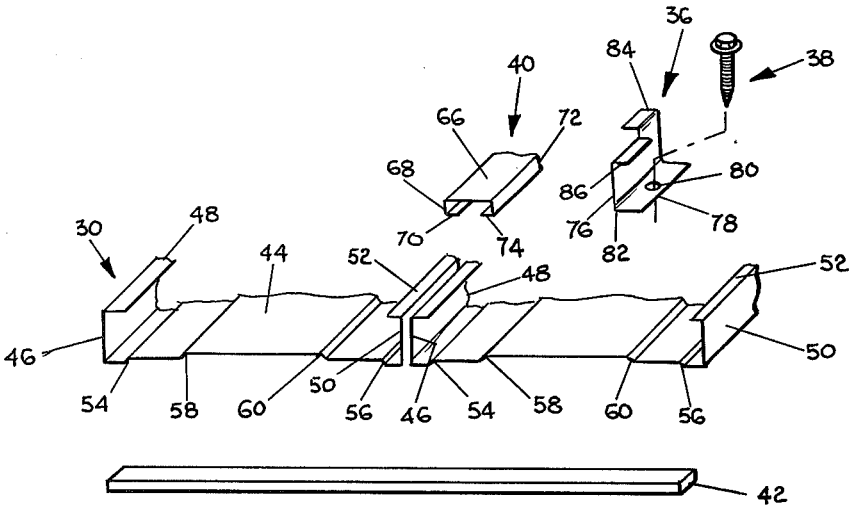
FIG. 2 is an exploded perspective view of the roof assembly according to the invention.
Figure 3:
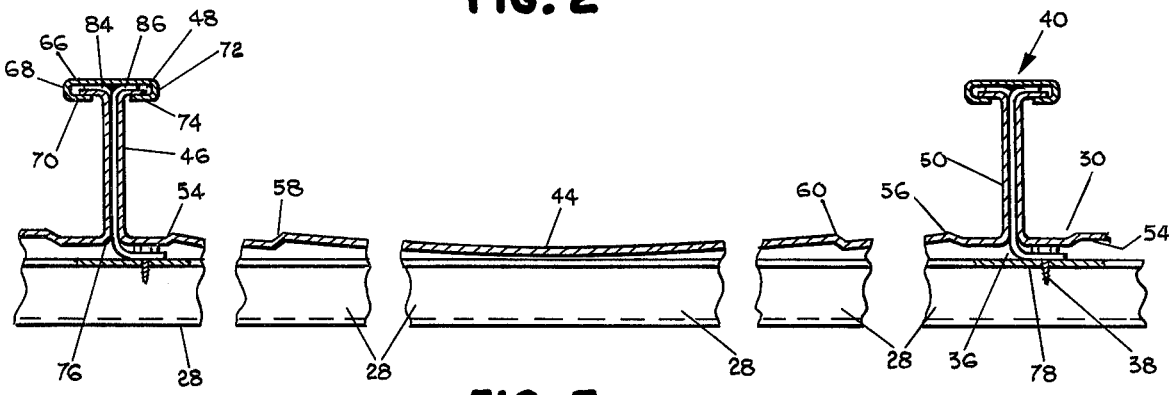
FIG. 3 is a cross-sectional view taken along lines 3—3 of FIG. 2.

Reference is now made to FIGS. 2 and 3 for a description of the roof construction according to the invention. The roof panel construction comprises roof panels 30, fastening clips 36, screws 38, elongated battens 40 and a resilient, pliable caulking 42.

The roof panels 30 are formed in a relatively flat shape with upstanding side wall portions. A relatively flat central sheet portion 44 is flanked by vertical upstanding side walls 46 and 50. An inwardly directed flange 48 extends from the top of the side wall 46 and an inwardly directed flange 52 extends from the top of side wall 50. The central sheet portion 44 includes a pair of centrally located elongated step ribs 58 and 60 and a pair of side flexing step ribs 54 and 56. These step ribs strengthen the panels in longitudinal direction.

The side ribs 54 and 56 are positioned quite close to the upstanding side walls 46 and 50 respectively consistent with the ability to form such ribs closely adjacent to the upstanding side walls. For example, the ribs 54 and 56 are desirably positioned less than one inch from the side walls in a panel which is approximately eighteen inches wide. The side ribs 54, 56, 58 and 60 are quite small in relation to the overall width and length of the panels but provide significant strength to the panels so that the panels withstand very high winds. For example, in an 18-inch width panel with 2 and ¾ inch high side walls, the rib height of about 3/32 inch and width of about 3/16 inch have been found to be quite satisfactory in achieving a high uplift rating. The side ribs 54 and 56 not only provide for added rigidity to the panel in a longitudinal direction but also provide strength and flexibility for the panel at critical points so that the panel can resist upward wind pressure. For example, upward pressure on the panel, as for example experienced during hurricanes and other high wind storms, tends to push the central portion of the panels upwardly, thereby drawing the side walls 46 and 50 inwardly at the base. So long as the roof does not come apart at the batten and returns to its normal shape, it will be satisfactory. However, this type of wind action tends to buckle the panels at the side walls 46 and 50 due to the high upward forces at the central sheet portion 44 of the panels. The invention unexpectantly strengthens the panel against this type of buckling action with the use of the elongated step rib structure 54 and 56 closely adjacent to the upstanding side walls. The ribs provide a little slack in the panel and provide a strengthening of the side walls against the buckling action. Further, and perhaps more important, the ribs provide a flexibility for the panel at critical points near to the upstanding side walls. In other words, as an upward force is applied on the central portion of the panel, the panel will flex at the step ribs 54 and 56 instead of at the base of the upstanding side walls 46 and 50. It is the pulling away of the side walls at the base thereof which causes buckling. Therefore, the ribs 54 and 56 unexpectedly strengthen the panel considerably against buckling under high upward pressures.

The batten 40 is of conventional sheet metal construction, comprising a top sheet 66, downwardly bent sides 68 and 72 and inwardly bent flanges 70 and 74. As illustrated in FIG. 3, the batten envelopes the top portion of the clip and the inwardly directed flanges 48 and 52 on the panels to join the same together in a tight locking construction. Typically, the battens will be bent into this shape with a conventional seaming machine which rolls along the top of the batten to bend the flanges 70 and 74 tightly against the underside of flanges 48 and 52, although this operation can conceivably be accomplished with hand tools.

The clip 36 has an upright body portion 76, a bottom flange 78 with hole 80, and top flanges 84 and 86 bent in opposite directions. A radial bend 82 is provided between the upright body portion 76 and the bottom flange 78 for added strength to the clip and further to provide a slight clearance for the positioning of the head of the screw 38 between the top of the flange 78 and the underside of the panel central sheet portion 44 as seen in FIG. 3. The clip can be made from any suitable strong sheet metal, preferably galvanized steel. The flat resilient caulking 42 is generally rectangular shape in cross-section and formed of a solid, resiliently compressible material which conforms to the shape of the panels when compressed. The caulking is typically about 3/32 inch thick and about ½ inches wide.

The roof structure is assembled in a manner from left to right as viewed in FIG. 3. A panel is positioned in place at the edge of the roof in a conventional manner. A clip 36 is then positioned at the right side of the panel with flange 84 extending over the top of flange 52. The screw 38 is positioned in the hole 80 and threaded into the purlin 28. To this end, the screw 38 can be a self-drilling metal screw. The next adjacent panel is then positioned in place with flange 48 positioned beneath the clip flange 86. The batten 40 is then positioned over the clip flanges 84 and 86 and around the panel flanges 52 and 48. A seaming machine, which is conventional in the art, then rolls along the top of the batten 40 to squeeze and bend the batten flanges 70 and 74 in tight engagement with the clip and panel flanges to form a tight seam.

In actual practice, the central sheet portion 44 will rest against the purlin 28 in the absence of an upward force on the panels as illustrated in FIG. 3. The distance between the central portion of the panel and the purlin would be only 3/16 of an inch if the panel did not deflect downwardly somewhat to abut the panel. The downward deflection of the panel tends to prestress the panel in a downward direction so that it takes more force to push the panel upwardly.

During the construction process, the caulking 42 is placed between overlapping panels, at the eaves and at the ridge. Typically two caulking strips will be laid on a purlin in slightly spaced parallel relationship. The panels 30 are then positioned on the caulking in a manner described above. The screws 38 are driven through the panels 30 between the caulking and into the purlins. This construction makes an extremely tight seam between the eaves and the roof at a relatively low cost.

In actual practice, the roof section formed in the manner illustrated in FIG. 3 of 24-gauge material eighteen inches wide has attained a UL 90 uplift rating. Similar structures without the elongated side step ribs 54 and 56 and without the radius bent clips have failed to obtain this rating.

The relatively flat panel construction provides a flat-roof construction free from severe ribbing, other than at the side walls to provide an even surface for the caulking 42 between the panels and at the ridge and eaves of the roof structure. Thus, the roof can be sealed at the ends of the panel without the use of expensive preformed plugs which must otherwise be provided at the eaves of the roof. The roof structure according to the invention is also extremely watertight and typically remains sealed when standing water on the roof rises up to the battens, as sometimes occurs when snow builds up on the roof.

Reasonable variation and modification are possible within the scope of the foregoing disclosure and drawings without departing from the spirit of the invention which is defined in the appended claims.

The embodiments of the invention is which an exclusive property or privilege is claimed are defined as follows:

1. In a metal roof construction supported by a roof support means, the roof construction having:

a plurality of elongated panels joined together at the side edges thereof, each panel having a relatively flat central portion generally defining a plane and flanked by a pair of upstanding substantially vertical side walls with inwardly directed flanges at the top portions thereof, said side walls extending down to the plane of the central portion, means extending between adjacent panels and over the top of the inwardly directed flanges of the panel side walls for securing the panels to the roof support means; and elongated batten strips crimped around the joints between the adjacent panels at the side wall flanges thereof so that the side walls of the panels are in abutting relationship substantially along the entire height, the improvement which comprises:

a shallow, elongated strengthening step rib formed solely of an upward or downward bend and a lateral bend in the panel central portion and extending the length of each panel closely adjacent to, but spaced from, each side wall thereof, the angles of the bends formed by the step rib and the flexibility of the panel being such that said panel central portion extends out of said plane at said step rib but returns to said plane adjacent thereto;

the strengthening step rib being shallow enough so as to maintain the flat nature of the panel central area and close enough to the side walls such that the strengthening step rib provides a point of flexure for the panel central portion under high upward stress and the strengthening rib being located sufficiently close to the upstanding side wall so as to strengthen the bottom portion thereof against a buckling force;

whereby the panel side walls have a significantly increased resistance to buckling at the bottom portion thereof.

2. A metal roof construction according to claim 1 wherein the ratio of side wall height to the height of the strengthening step rib is in excess of 100 to 1.

3. A metal roof construction according to claim 2 wherein the ratio of the side wall height to the strenthening step rib height is about 300 to 1.

4. A metal roof construction according to claim 2 wherein the strengthening step rib is within about 1 inch of the side wall.

5. A metal roof construction according to claim 2 wherein the ratio of the width of the panel to the distance from the strengthening step rib to the side wall is about 18 to 1 to 23 to 1.

6. A metal roof construction according to claim 5 wherein the ratio of the width of the panel to the distance from the strengthening step rib to the side wall is about 20.5 to 1.

7. A metal roof construction according to claim 6 wherein a pair of second facing step ribs are formed in a central portion of the panel inwardly of the first mentioned strengthening step ribs, the second step ribs also being of a low height with respect to the width of the panel such that the portions of the panel between the facing step ribs normally lie on the roof support means.

8. A metal roof construction according to claim 7 wherein the panel securing means comprises:

a clip of sheet metal having:

an upstanding body portion which is positioned between the side walls of adjoining panels, a bottom flange which is bent laterally of the body portion at a bottom portion thereof and is positioned beneath a panel, and a pair of top flanges which are bent in opposite directions laterally of the body portion at a top portion thereof and in overlying relationship with the inwardly directed flanges of adjacent panel side walls;

a threaded fastener having a head, the fastener passing through the clip bottom flange and secured to the roof support means, the bend between the clip body and lower flange having a radius sufficient to accommodate the threaded fastener head which lies between the top surface of the clip bottom flange and the undersurface of the panel lying above the fastener.

9. A metal roof construction according to claim 8 wherein the bends between the top flanges and body portion have a radius of curvature to maximize the strength of the top flanges.

10. A metal roof construction according to claim 9 wherein said panels overlap at end edges thereof and further comprising a solid, relatively compressible caulking material positioned between overlapping panels.

11. A metal roof construction according to claim 10 and further comprising a strip of solid, relatively compressible caulking material positioned between an end of the panels and the support means to seal the panels at the ends thereof from water.

12. A metal roof construction according to claim 1 wherein the ratio of the side wall height to the strengthening step rib height is about 300 to 1 and wherein the strengthening step rib is positioned within about 1 inch of the adjacent side wall.

13. A metal roof construction according to claim 1 and further comprising a pair of second facing step ribs formed in a central portion of the panel inwardly of the first mentioned strengthening step ribs, the second step ribs being of a low enough height with respect to the width of the panels such that the portion of the panel between the second step ribs normally lies on the roof support means.

14. A metal roof construction according to claim 1 wherein the panel securing means comprises:

a clip of sheet metal having:

an upstanding body portion which is positioned between the side walls of adjoining panels, a bottom flange which is bent laterally of the body portion at the bottom portion thereof and lying beneath a panel, and a pair of top flanges which are bent in opposite directions and laterally of the body portion at a top portion thereof and in overlying relationship with the inwardly directed flanges of adjacent panel side walls;

a threaded fastener having a head, the fastener passing through the clip bottom flange and secured to the roof support means;

the bend between the clip body and lower flange having a radius sufficient to accommodate the threaded fastener head which lies between the top surface of the clip bottom flange and the undersurface of the panel lying above the fastener.

15. A metal roof construction according to claim 14 wherein the bends between the top flanges and body portions of the clip have a smooth radius of curvature to maximize the strength of the clips at the bends.

16. A metal roof construction according to claim 14 wherein the panels overlap at end edges thereof and further comprising a solid, relatively compressible caulking material positioned between overlapping panels.

17. A metal roof construction according to claim 14 and further comprising a strip of solid relatively compressible caulking material positioned between an end of the panels and the support means to seal the panels at the ends thereof from water.

18. A metal roof construction according to claim 1 wherein the panels overlap at end edges thereof and further comprising a solid, relatively compressible caulking material positioned between overlapping panels.

19. A metal roof construction according to claim 1 and further comprising a strip of solid relatively compressible caulking material positioned between an end of the panels and the support means to seal the panels at the ends thereof from water.

20. In a metal roof construction supported by a roof support means, the roof construction having:

a plurality of elongated panels joined together at the side edges thereof, each panel having a relatively flat central portion generally defining a plane flanked by a pair of upstanding substantially vertical side walls with inwardly directed flanges at the top portions thereof, the side walls exending down to the plane of the central portion, means extending between adjacent panels and over the top of the inwardly directed flanges to the panel side walls for securing the panels to the roof support means; and elongated batten strips crimped around the joints between the adjacent panels at the side wall flanges thereof so that the side walls of the panels are in abutting relationship substantially along the entire height, the improvement which comprises:

a shallow, elongated strengthening step rib formed in the panel central portion and extending the length of each panel closely adjacent to, but spaced from, each side wall thereof, the step rib formed solely by an upwardly or downwardly extending bend and a lateral bend, the angles of the bend being such that the central portion of the panel extends upwardly out of a plane formed by the panel central portion and then returns to the plane adjacent to the step rib so that the central portion of the panel is substantially flat notwithstanding the strengthening step ribs;

the ratio of the side wall height to the height of the strengthening rib being in excess of 100 to 1 so as to maintain the flat nature of the panel central area and the ratio of the width of the panel to the distance from the strengthening rib to the side wall being about 18 to 1 to 23 to 1 so that the strengthening step rib provides a point of flexure for the panel central portion under high upward stress and so that the strengthening rib strengthens the side wall bottom portion against a buckling force.

* * * * *